US005735957A

United States Patent [19]

Becker et al.

[11] Patent Number: 5,735,957

[45] Date of Patent: Apr. 7, 1998

[54] DUAL CHAMBER FILM APPLICATOR WITH IN-POND OVERFLOW

[75] Inventors: Rex A. Becker, Janesville, Wis.; Alfred C. Li, Naperville, Ill.; James R. Burns, Springfield, Pa.

[73] Assignee: Beloit Technologies, Inc., Wilmington, Del.

[21] Appl. No.: 537,598

[22] Filed: Oct. 2, 1995

[51] Int. Cl.[6] ..... B05C 3/02

[52] U.S. Cl. ..... 118/411; 118/419

[58] Field of Search ..... 118/411, 419, 118/413; 427/356

[56] References Cited

U.S. PATENT DOCUMENTS

| | | | |
|---|---|---|---|
| 4,357,370 | 11/1982 | Alheid | 427/211 |
| 4,369,731 | 1/1983 | Damrau | 118/410 |
| 4,643,127 | 2/1987 | Wanke | 118/413 |
| 4,688,516 | 8/1987 | Sommer | 118/410 |
| 4,761,309 | 8/1988 | Embry | 427/294 |
| 4,834,018 | 5/1989 | Sollinger et al. | 118/410 |
| 4,839,201 | 6/1989 | Rantanen et al. | 427/355 |
| 4,860,686 | 8/1989 | Kato et al. | 118/410 |
| 4,903,632 | 2/1990 | Sollinger | 118/123 |
| 4,961,968 | 10/1990 | Shands et al. | 427/356 |
| 5,183,691 | 2/1993 | Hassell et al. | 427/286 |
| 5,192,591 | 3/1993 | Chance | 427/356 |
| 5,199,991 | 4/1993 | Chance | 118/410 |
| 5,366,551 | 11/1994 | Aidun | 118/411 |

FOREIGN PATENT DOCUMENTS

| | | |
|---|---|---|
| 0 436 172 A1 | 12/1990 | European Pat. Off. . |
| 0 571 849 A1 | 5/1993 | European Pat. Off. . |

OTHER PUBLICATIONS

"BA1500™ Coater: Versatile, high speed blade applicator produces quality coated papers," a brochure by Rader Companies, a division of Beloit Corporation.

"New Coating Technologies Combine High Speeds With Higher Quality," an article in Pulp & Paper by Andy Harrison pp. 60–64—May 1994.

*Primary Examiner*—Brenda A. Lamb

*Attorney, Agent, or Firm*—Dirk J. Veneman; Raymond W. Campbell; Gerald A. Mathews

[57] ABSTRACT

An applicator head is positioned beneath a backing roll and has a housing divided into three sections. A first coating pond is defined between an overflow barrier and a first wall. A converging plate extends between the first wall and a second wall, and converges toward the substrate, and a second pond is defined between the plate and an end wall. Coating is introduced to both ponds. A low pressure cavity is defined beneath the converging plate and between the first wall and the second wall. The cavity opens to the second pond, and draws air and excess coating from the second pond. The substrate is prewetted as it passes through the first pond, and coating deprived of entrained air is applied to the substrate in the second pond. Coat weight uniformity and increased machine speeds are thus achievable.

2 Claims, 2 Drawing Sheets

74
24
36
25
41
62
27
20
23
22
36

DUAL CHAMBER FILM APPLICATOR WITH IN-POND OVERFLOW

FIELD OF THE INVENTION

The present invention relates to apparatus for applying coatings to moving substrates in general, and to short dwell coaters for paper webs in particular.

BACKGROUND OF THE INVENTION

Paper is formed of a mat of fibers, typically cellulose fibers from wood, produced by draining fibers from stock in a papermaking machine. The fibers making up a sheet of paper influence the paper's surface finish or texture. The surface attributes of the paper may be modified by calendering or chemically treating the paper. However, for many applications, such as for the paper employed in magazines and printed advertising in flyers, a desirable glossy high brightness finish can best be achieved by coating the paper.

The coating material is typically comprised of a mixture of clay or fine particulate calcium carbonate which provides a flat filled surface; titanium dioxide for white coloring; and a binder. Coated papers come in a number of weights and grades depending on the weight of the paper and the thickness of the coating.

One type of coater, called a flooded nip coater, is particularly suitable for heavier grades of coated paper, and employs a roll partly submerged in a bath of coating. The roll transfers a film of coating to one side of the paper web. The coated web is wrapped around a backing roll which forms a controlled gap with the coating roll. Following contact with the coating roll the web passes around the backing roll to a metering blade which contacts the applied coating and controls the overall thickness of the coating.

For lightweight paper grades, which may be run at higher machine speeds, the short dwell coater has been developed. The short dwell coater maintains a pond of coating which is held against a backing roll. A paper web is directed about the backing roll through the pond. The web's short dwell time in this low-pressure pond of coating results in a relatively thin application of coating on the web.

An improved coater known as the BA 1500 coater by Beloit Corporation employs a combination of a short dwell coater with a smoothing blade similar to the flooded nip coater and has proven practical at a wide range of paper weights and paper speeds.

Short dwell coaters are advantageously used for coating fluids on lightweight and other grades of paper. The short dwell coater employs a pond of coating material. The pond is formed in a feed cavity and fed with an excess of coating material. The pond is caused to overflow in the up machine direction thereby flooding the web and pre-wetting it as it approaches the pond. On the downstream side, a metering blade controls the amount of coating material which is applied to the moving web. The coating material is fed into the pond and against the moving web at relatively low velocity. Upon contact with the web, the coating material becomes accelerated by the web which is moving at a velocity of 75 to 100 feet per second or more. The resultant formation of a high velocity boundary layer of coating impinges on the doctoring blade and the excess coating is turned downwardly into the pond creating a recirculating zone between the down machine end of the pond and the coating feed at the up machine end of the pond. The paper web as it enters the pond and is wetted by the pond pulls along a boundary layer of air which penetrates some distance into the pond as the web moves through the pond.

The location where the paper becomes wetted by the coating material is defined as the dynamic contact line. As the speed of the machine increases, the fluid flow in the pond destabilizes and the recirculating flow forms a vortex. The result of this vortex and destabilized flow is that the dynamic contact line oscillates both in the machine direction and in the cross-machine direction. These phenomena, the destabilizing nature of the flows and the accumulation of air in the vortex within the pond, result in coating defects which can manifest themselves as streaks on the coated paper.

Although increasing the paper web speed in a papermaking machine can have deleterious effects on the quality, increased machine speed is essential to increased productivity and reduced costs. A papermaking machine is a very substantial capital investment which must be amortized over the quantity of paper manufactured thereon. Therefore, increasing the machine speed is critical to continued increase in the papermaking productivity.

Paper is typically more productively produced by increasing the speed of formation of the paper and coating costs are kept down by coating the paper while still on the papermaking machine. Because the paper is made at higher and higher speeds and because of the advantages of on-machine coating, the film applicators in turn must run at higher speeds. Currently, coating applicators apply coating to a substrate in two separate manners. One is a direct application of a thin film by the coating applicator into a moving web. The other is by application onto a transfer medium, i.e., an applicator roll, which then applies the thin film of fluid onto the web. Devices using either application approach may be classified as film applicators. A substrate can be comprised of a web, felt, blanket, plate, roll, or any other medium to which a film of coating is to be applied. The need in producing lightweight coatings to hold down the weight of the paper and the costs of the coating material encourages the use of short dwell coaters which, by subjecting the paper web to the coating material for a short period of time, limit the depth of penetration of the coating and hence the coating weight.

Thus, high speed film applicators are key to producing lightweight coated papers cost-effectively. However, the use of short dwell coaters at high machine speeds has led to defects in the coating, typically coating streaks. Coating streaks can be caused by air entrained along the boundary layer of the raw stock or substrate. The entrained air forms bubbles in the coating pond, and the bubbles pressing up against a metering blade prevent the coating from uniformly flowing under the blade.

What is needed is a film applicator capable of functioning at higher speeds, like the short dwell coater, but without inducing defects in the paper produced.

SUMMARY OF THE INVENTION

The film applicator of this invention has an applicator head which is positioned beneath a backing roll. The applicator head has a housing divided into three sections. A first coating pond is defined between an overflow barrier and a first wall. A converging plate extends between the first wall and a second wall, and converges toward the substrate, and a second pond is defined between the plate and an end wall. Coating is introduced to both ponds. A low pressure cavity is defined beneath the converging plate and between the first wall and the second wall. The cavity opens to the second pond, and draws air and excess coating from the second pond. The substrate is prewetted as it passes through the first pond, and coating deprived of entrained air is applied to the substrate in the second pond. Coat weight uniformity and increased machine speeds are thus achievable.

It is a feature of the present invention to provide a film applicator which may operate at higher machine speeds.

It is an additional feature of the present invention to provide a film applicator which removes entrained air from the coating pond prior to application of the coating to the substrate.

It is another feature of the present invention to provide an apparatus which applies a uniform coating to substrates moving at high speeds.

It is also a feature of the present invention to provide a film applicator with reduced variations in the flow of coating.

It is a further feature of the present invention to provide a film applicator wherein flow instabilities are prevented from propagating to the applicator metering element.

Further objects, features and advantages of the invention will be apparent from the following detailed description when taken in conjunction with the accompanying drawings.

DESCRIPTION OF THE PREFERRED EMBODIMENT

Figure 1:
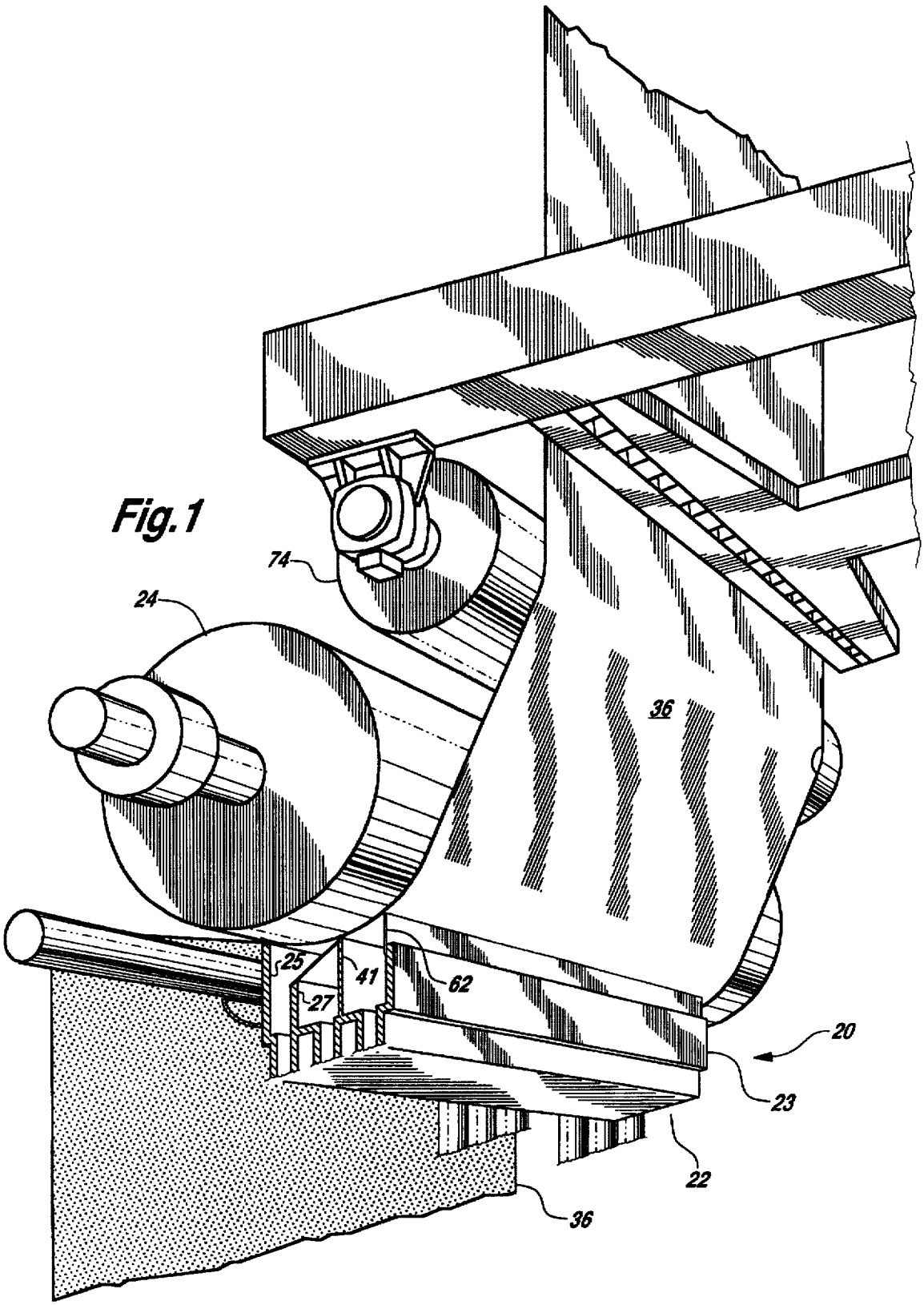
FIG. 1 is a perspective view partly cut away in section of the applicator of this invention.
Figure 2:
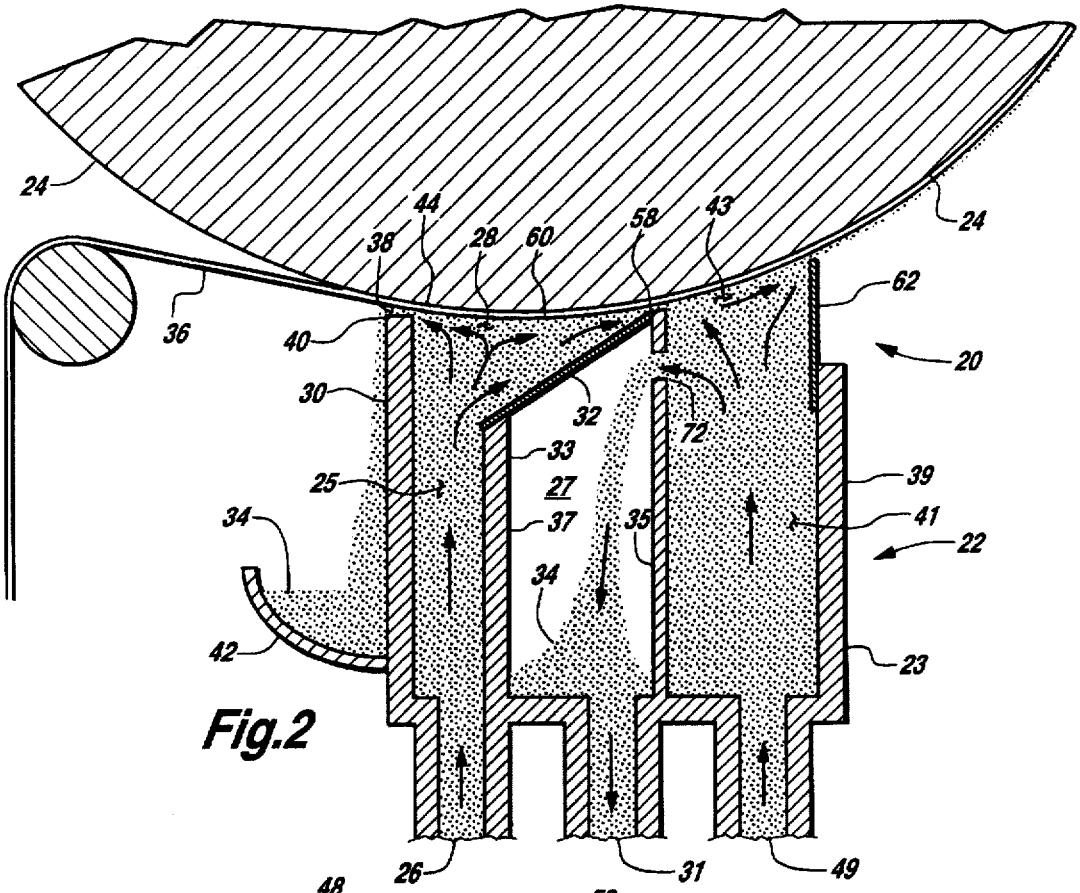
FIG. 2 is a cross-sectional elevational view of the applicator of FIG. 1.
Figure 3:
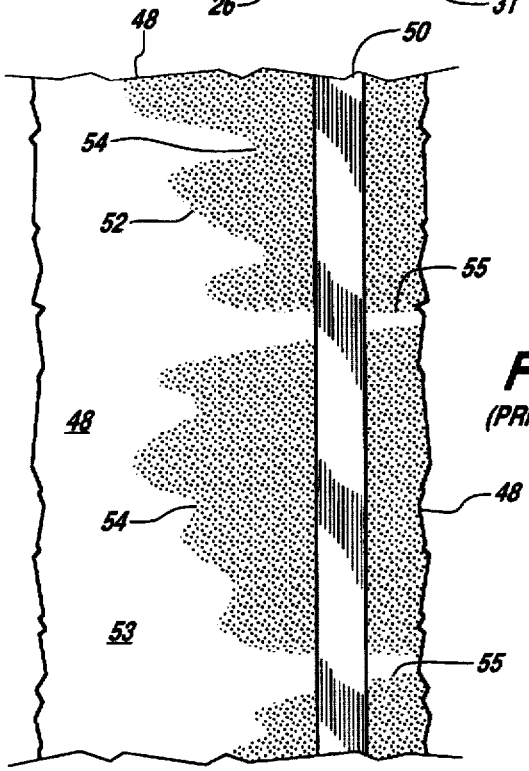
Fig.3 (PRIOR ART)
FIG. 3 is a fragmentary view of a substrate passing through a prior art coater, and the resultant coating disposition on the substrate.

Referring more particularly to FIGS. 1–3, wherein like numbers refer to similar parts, a film applicator 20 is shown in FIGS. 1 and 2. An uncoated substrate 36 passes through the applicator 20 for the application of coating to the surface thereof. The applicator 20 has an applicator head 22 which extends at least the width of the substrate and which is positioned beneath a backing roll 24. The applicator head 22 has a rigid housing 23 which is divided into three sections. Each section extends in the cross-machine direction along the entire length of the applicator head 22. The first section 25 defines a first pond 28 which extends between a baffle plate 30 and a converging plate 32. Coating is introduced through the first inlet 26 to fill the first pond 28 and overflows in an upstream direction over the lip 40 of the baffle plate 30. The overflow over the lip is collected in a trough 42 for recycling.

A converging plate 32 extends from a first wall 33 to a second wall 35. The outer side of both the first wall and the second wall are generally parallel to the baffle plate 30. The first wall 33 is spaced from the backing roll 24 and the second wall is adjacent to or closely spaced from the backing roll 24. The first wall 33 and second wall 35 form the second section 27 which is a controlled pressure recirculation chamber 37. The recirculation chamber 37 has an outlet 31 which may be controlled by a valve (not shown) for regulating the pressure in the chamber 37. The valve is adjustable to control the discharge pressure and the internal pressure in the system.

The applicator head 22 has an end wall 39 which is generally parallel to the second wall 35. A third section 41 is defined between the second wall 35 and the end wall 39. The third section 41 forms a second pond 43. The second pond 43 has a second coating inlet 49. Mounted to the end wall 39 is a metering blade 62. Coating 34 in the ponds 28, 43 is applied to the substrate 36 as it runs between the backing roll 24 and the applicator head 22.

The substrate 36 enters the applicator head 22 through a gap 38 between the backing roll 24 and the upper lip 40 of the baffle plate 30. Coating 34 overflows the baffle plate 30 and is allowed to escape the first pond 28 through the gap 38. The gap 38 is typically between one-sixteenth and one-quarter of an inch high and the overflow of coating through the gap adjacent to the substrate helps to decrease the amount of air which is brought by the boundary layer of the paper 36 into the pond 28. The overflow or flood of coating 34 which flows through the gap displaces a portion of the boundary layer. A dynamic contact line 44 is defined where the coating 34 comes into contact with the substrate 36 displacing the entrained boundary layer.

The difficulties in achieving an even coating on a substrate at high speeds are illustrated in FIG. 3, which shows a substrate 48 in a prior art coater as it transits a coating pond (not shown) and a metering blade 50. The dynamic contact line 52 is not uniform but oscillates both in the machine direction and the cross-machine direction. Incursions of the boundary layer toward the metering blade 50 present air fingers 54 which can extend past the metering blade 50 to become streaks 55.

When applicators are run at high speeds, and with some coating formulations, they are subject to two problems related to the boundary layer of air which is pulled into the pond. The first relates to the flow regime created by the substrate. When a papermaking machine is running at high machine speeds, that is in the neighborhood of three-and-a-half to six thousand feet per minute, the moving substrate can induce hydrodynamic flow instability in the pond. This flow instability is chaotic in nature. A chaotic system is one in which the future state of the system cannot readily be predicted from the past states of the system. In practice it means, as shown in FIG. 3, that air fingers and streaks appear and disappear and move over time in a way that is not readily predictable. Thus, it is difficult to find an applicator design which eliminates the streaks in a chaotic environment.

A second problem caused by the interface of the rapidly moving substrate and the applicator in a pond is that a vortex is created by the recirculation of coating within the pond. The vortex can entrap air bubbles which subsequently become entrained in the flow and cause streaks in the coated layer being formed.

In the applicator head 22, the converging plate 32 extends from the first wall 33 to an engagement point or gap 58 where the plate closely approaches the substrate 36 and the backing roll 24. The converging plate 32 defines a region 60 of the pond which is narrowly tapered. The region 60 tapers in the machine direction and defines a narrow wedge which restricts flow to a stable, uniform flow. Once the flow is stable it is no longer subject to cross-machine fluctuations and thereby will produce a smooth coating.

The second section 27 of the applicator head 22 is a low pressure cavity 37. The cavity is defined by the first wall 33, the second wall 35 and the converging plate 32. A hole 72 in the second wall 35 allows passage of coating and entrained air from the second pond 43 to overflow into the cavity 37. The cavity 37 may have a valve (not shown) which allows the control of the pressure within the chamber 37. The pressure is generally maintained at below atmospheric levels, but in any event below the pressure level within the second pond. The overflow of coating 34 through the hole 72 creates a low pressure region to induce migration of air out of any vortex formed in the second pond 43. The cavity 37 with hole 72 thus provides a means for withdrawing coating from the second pond 43, whereby entrained air and coating are removed from the second pond 43.

The metering blade 62 controls the depth of coating applied to the substrate 36 as it transits the applicator head 22. In operation, the applicator head 22 functions as follows: the substrate 36 enters the first coating pond 28 over the lip 40 of the baffle plate 30 where overflowing coating 34 strips away a majority of the boundary layer. The substrate 36 then moves into the first pond and into the tapered region 60. The substrate 36 is pre-wetted with coating in the first pond 28 and the converging wedge formed by the tapered region 60 forces coating against the substrate 36. After the substrate transits the gap 58, the second pond 43 applies coating to any low coating weight zones resulting from air entrainment which may remain after the converging zone 60. The low pressure region created by the hole 72 draws any air out of the second pond 34 which is carried over from the first pond 28. The substrate 36 passes over the metering blade 62. For a paper web, it then passes over a turning roll 74 and enters a dryer section (not shown).

Thus, the first pond 28 and the converging plate 32 perform the function of pre-wetting and pre-metering the substrate 36 while increasing the contact time between the coating and the paper. The first coating pond 28, together with the converging plate, prevents the dynamic contact line from moving in close proximity to the metering blade 62. The gap formed between the converging plate and the roll also limits the amount of entrained air and coating which enters the second pond 43.

In some circumstances for removal of air from the first pond, it may be desirable to perforate the converging plate 32 so as to create a low pressure region adjacent to the plate and draw air out of a vortex formed within the first pond 28.

It also may be desirable in some circumstances to make the metering blade 62 into a premetering blade which leaves a relatively thick coating on the substrate which is subsequently stripped by a final metering element to the desired final coating thickness.

It should be understood that the converging angle of the converging plate and the location of the in-pond venting channel may be varied, and that the volume of the ponds 28, 43 may be varied. Further, the volume of the low pressure cavity 37 may be varied. Furthermore the addition of overflow controls could be used to dampen pressure fluctuations inside the applicator ponds.

It is understood that the invention is not limited to the particular construction and arrangement of parts herein illustrated and described, but embraces such modified forms thereof as come within the scope of the following claims.

We claim:

1. A film applicator for applying coating material to a traveling substrate, the applicator comprising:

a backing roll which engages the substrate to be coated;

an applicator head, including a housing positioned beneath the substrate and the backing roll;

an upstream baffle plate which extends toward the backing roll from the housing;

a first wall which extends toward the backing roll from the housing, wherein the first wall is spaced downstream from the baffle plate;

a converging plate which extends from the first wall into close proximity with the backing roll, wherein the converging plate extends toward the substrate in the downstream direction to define a wedge-shaped region of the applicator head, and wherein coating is introduced by a first means into a first pond defined between the baffle plate and the converging plate, such that coating overflows the baffle plate and is applied to the substrate between the backing roll and the converging plate;

a second wall which extends toward the backing roll from the housing downstream of the first wall, wherein the converging plate extends between the first wall and the second wall;

a metering element positioned downstream of the second wall and extending from the housing toward the backing roll, wherein a second coating pond is defined between the second wall and the metering element, and wherein coating is supplied by a second means to the second pond for application to the substrate as it exits the first pond;

a cavity is defined between the first wall the second wall, and the converging plate, which cavity is maintained at a pressure below the pressure within the second pond, and portions of the second wall define an opening therein to thereby draw coating and air entrained in the coating through the opening in the second wall and into the cavity.

2. A film applicator for applying coating material to a traveling substrate guided by a backing roll, said applicator comprising:

an applicator head, including a housing disposed in close proximity to the backing roll such that the substrate guided by the backing roll moves between the backing roll and the applicator head, wherein the housing defines a first section having a first pond, a second section having a recirculation chamber, and a third section having a second pond, the second section disposed intermediate the first and third sections, wherein the first pond opens toward the substrate and extends along the substrate in a cross-machine direction, and wherein the first pond receives coating material from means for supplying pressurized coating material, and wherein the second pond is independently connected to a means for supplying coating material;

hole means linking the second pond and the recirculation chamber in fluid communication;

a baffle plate which extends from the housing upstream of the first pond, wherein the baffle plate has portions defining a lip spaced from the backing roll, and wherein excess coating material within the first pond overflows the baffle plate lip to escape the first pond;

a converging plate mounted to the housing downstream of the baffle plate and within the first pond, wherein the converging plate closely approaches the substrate against the backing roll, and wherein the converging plate extends toward the substrate in the downstream direction to define a wedge-shaped region of the first pond, and wherein coating is applied by the converging plate to the substrate;

a metering element mounted to the housing downstream of the second pond for intercepting and removing excess coating material on the substrate; and wherein the recirculation chamber is a sealed low pressure cavity, and wherein coating and entrained air from the second pond can migrate into the recirculation chamber via the hole means.

* * * * *